US010899496B2

(12) United States Patent
Hengami

(10) Patent No.: US 10,899,496 B2
(45) Date of Patent: Jan. 26, 2021

(54) DUAL COMPARTMENT DISPENSING BOX WITH TOP SIDE SLIDE OPENINGS

(71) Applicant: David Todjar Hengami, Torrance, CA (US)

(72) Inventor: David Todjar Hengami, Torrance, CA (US)

( * ) Notice: Subject to any disclaimer, the term of this patent is extended or adjusted under 35 U.S.C. 154(b) by 0 days.

(21) Appl. No.: 16/387,495

(22) Filed: Apr. 17, 2019

(65) Prior Publication Data

US 2019/0315513 A1 Oct. 17, 2019

Related U.S. Application Data

(60) Provisional application No. 62/659,064, filed on Apr. 17, 2018.

(51) Int. Cl.

| | |
|---|---|
| ***B65D 5/72*** | (2006.01) |
| ***B65D 5/48*** | (2006.01) |
| ***B65D 5/02*** | (2006.01) |
| ***B65D 85/60*** | (2006.01) |
| ***B65D 5/42*** | (2006.01) |

(52) U.S. Cl.

CPC ..... *B65D 5/723* (2013.01); *B65D 5/0227* (2013.01); *B65D 5/4266* (2013.01); *B65D 5/48014* (2013.01); *B65D 85/60* (2013.01)

(58) Field of Classification Search

CPC .... B65D 5/48014; B65D 5/723; B65D 5/646; B65D 85/60

USPC ..... 229/120.02, 120.03, 120.08, 125.12, 229/125.15, 120.12, 129.1, 120.24, 220, 229/120.11, 121; 221/91; 222/529

See application file for complete search history.

(56) References Cited

U.S. PATENT DOCUMENTS

| | | | | |
|---|---|---|---|---|
| 4,361,270 A * | 11/1982 | Roccaforte | ..... | B65D 5/723 229/120.03 |
| 6,435,402 B1 * | 8/2002 | Hengami | ..... | B65D 5/0263 229/117.3 |
| 2004/0065723 A1 * | 4/2004 | Hengami | ..... | B65D 5/723 229/125.12 |
| 2015/0321788 A1 * | 11/2015 | Hengami | ..... | B65D 5/0227 229/122 |

FOREIGN PATENT DOCUMENTS

| | | | | |
|---|---|---|---|---|
| FR | 2799743 A1 * | 4/2001 | ..... | B65D 5/723 |
| JP | 07223634 A * | 8/1995 | ..... | B65D 5/723 |

OTHER PUBLICATIONS

FR-2799743-A1 Machine Translation (Year: 2001).*

* cited by examiner

*Primary Examiner* — Nathan J Newhouse
*Assistant Examiner* — Phillip D Schmidt
(74) *Attorney, Agent, or Firm* — Cislo & Thomas, LLP

(57) ABSTRACT

A package for convenient dispensing of multiple kinds of candies, mints or the like is made from a single blank having top flaps including a pair of slides, and bottom flaps foldably extending from side panels running the length of the blank. The side panels are formed into a dual compartment box with a common front panel with a pair of openings allowing the candies or mints to pass. The slides are each separately moveable to block and unblock each of the openings. The box has a support tab that presses the slides against the front panel near the openings, and the slides have catches to keep at least some part of them inside the box.

8 Claims, 5 Drawing Sheets

DUAL COMPARTMENT DISPENSING BOX WITH TOP SIDE SLIDE OPENINGS

RELATED APPLICATIONS

This application claims priority to provisional application No. 62/659,064 filed Apr. 17, 2018 entitled "Dual Compartment Dispensing Box With Top Slide Openings."

BACKGROUND

Major food and candy manufacturers employ high-speed form, fill and seal packaging machines to produce numerous folded, filled and sealed boxes of a solid pourable product per minute. These machines typically receive either flat box blanks or partially-constructed boxes. A first end is folded and sealed. Then the boxes are filled with the product before the opposite end is folded and sealed, thereby finishing the manufacturing process. The types of solid pourable products such packaging machines are frequently used to package are, for example, mints, small candies, or similar items. To facilitate dispensing and present such a box more favored by consumers, the rapid form, fill and seal boxes often incorporate re-closable openings formed as part of the blank itself.

One type of closable box known in the art is formed from a cardboard box blank that may be rapid folded, and which offers a re-closable, sliding opening incorporated into the unassembled blank, and which is constructed during the folding process prior to sealing. Known types of closable boxes with slides include those having slides that move up and down at the top of the box and include a catch mechanism to prevent the slide from dislodging. Up to now, such boxes have been limited in that they include a convenient slide opening, but only have one opening and thus can contain only one product.

Therefore there remains a need for a box having two compartments and offering a convenient dual slide opening for easily dispensing a solid pourable or similar product, that is easy to manufacture on a mass production scale using conventional high-speed packaging machines, and that is constructed in such a way to avoid any slide insertion step, but that incorporates multiple independently operable slide openings. There is further a need for such a box having these characteristics while also having the same appearance and handling characteristics as a conventional box, wherein the top flaps are individually lifted to individually dispense the contents according to preference, and which is made from a single sheet of blank stock.

SUMMARY

A package for convenient dispensing of multiple kinds of candies, mints or the like starts with a single cardboard blank having a number of top and bottom flap portions foldably extending from a number of side panels running the length of the cardboard blank. The top flaps include a pair of slides, preferably each with a catch at the end. The side panels are formed into a box having a first compartment and a second compartment with a separator panel in between, and the compartments have a common front panel with a pair of openings sized to allow the multiple types of candies, mints or the like to pass from each of the compartments. The slides are independently moveable to selectively block and unblock each of the openings. The box preferably also has a support tab that presses the slides against the front panel near the openings upon formation of the box. The slide catches keep at least some part of the moveable slides inside the box upon its formation.

DESCRIPTION

Figure 1:
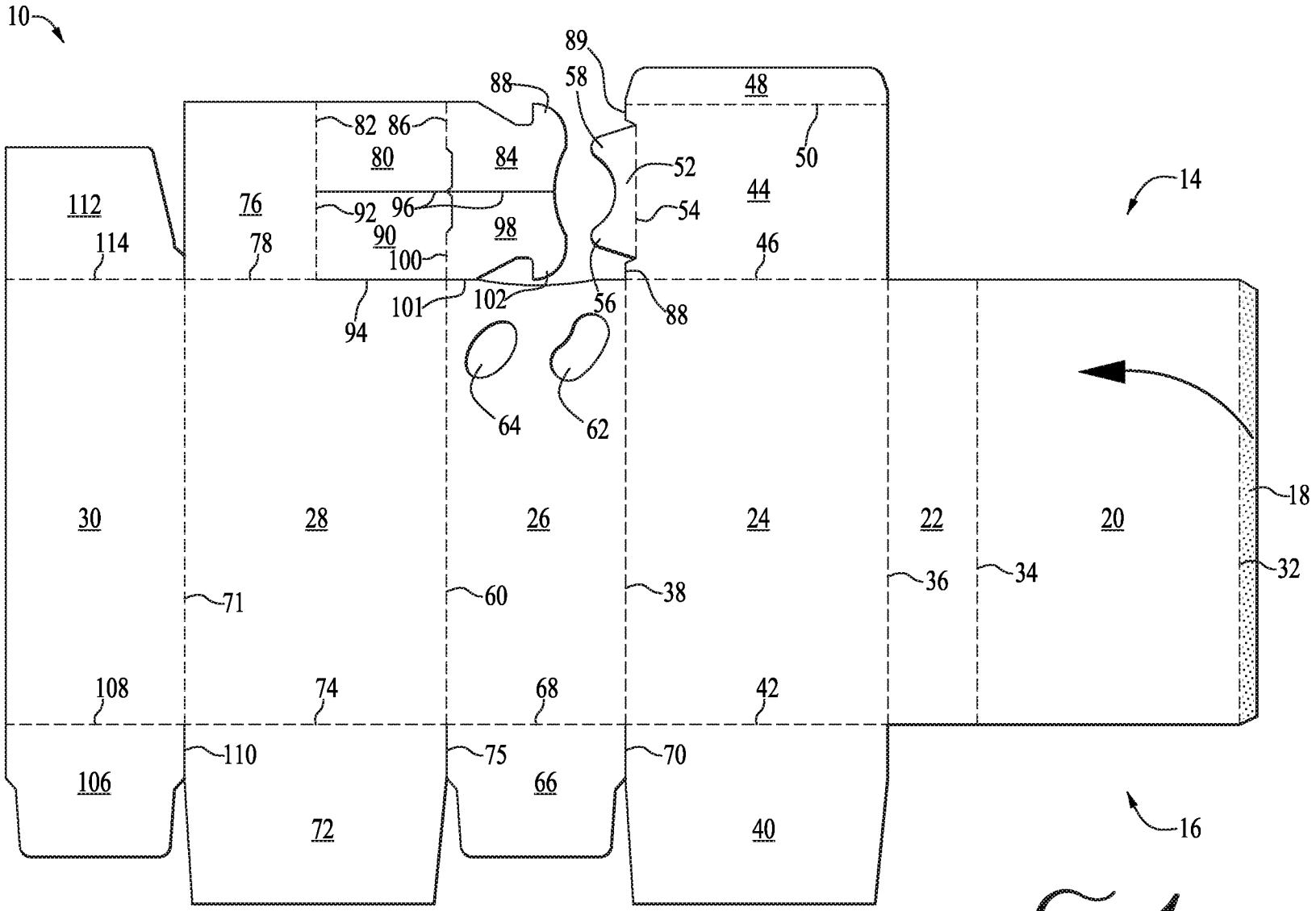
FIG. 1 is a flat pattern view of a cardboard blank which can be folded to form a dual compartment box with slide openings.

For purposes of the following discussion, box portions bearing the slides will be discussed as though oriented as the front of the box. Referring to FIG. 1, a die cut paper or cardboard blank 10 is shown that may be used to form the box 12 (FIGS. 3-6). The cardboard blank 10 has a top end 14 and a bottom end 16 and is scored for folding such that the box 12 has a first compartment 116 and a second compartment 118 (FIG. 3), preferably adjacent to one another. Major portions of the cardboard blank include inner tab 18, dual compartment separator panel 20, first compartment rear panel 22, first compartment side panel 24, front panel 26, second compartment side panel 28, rear panel 30, preferably all arranged in series and preferably configured in a foldable relationship to one another.

Still referring to FIG. 1, inner tab 18 is connected to dual compartment separator panel 20 along inner tab fold line 32. Dual compartment separator panel 20 is connected to first compartment rear panel 22 by dual compartment separator panel fold line 34. First compartment rear panel 22 is connected to first compartment side panel 24 by first compartment rear panel fold line 36. First compartment side panel 24 is connected to front panel 26 by first compartment side panel fold line 38. First compartment side panel 24 includes first bottom flap 40 connected along first bottom flap fold line 42. First compartment side panel 24 also includes major lid 44 connected along major lid fold line 46, major lid closure tab 48 connected along major lid closure tab fold line 50, and front tab 52 connected along front tab fold line 54. Note that tab 48 is optional and can be excluded to reduce the overall size of the blank 10 for paper or cardboard material savings. Major lid 44 includes first catch 88 and second catch 89, and front tab 52 includes first appendage 56 and second appendage 58.

Front panel 26 is connected to second compartment side panel 28 along front panel fold line 60. Front panel 26 lacks a top tab, but includes a second bottom flap 66 connected along second bottom flap fold line 68. Second bottom flap 66 is adjacent first bottom flap 40 and separated by first cut line 70. Front panel 26 includes first compartment aperture 62 and second compartment aperture 64.

Second compartment side panel 28 is connected to rear panel 30 along second compartment side panel fold line 71. Second compartment side panel 28 includes third bottom flap 72 connected along third bottom flap fold line 74. Third bottom tab 72 is adjacent second bottom tab 66, separated along second cut line 75. Second compartment side panel 28 also includes minor lid 76 connected along minor lid fold line 78. Both minor lid 76 and minor lid fold line 78 are preferably approximately one-half the width of second compartment side panel 28. Along the remaining width of the top end 14 of the second compartment side panel 28 is third cut line 94. Second compartment slide flap 90 is adjacent second compartment side panel 28 along third cut line 94. Second compartment slide 98 is connected to second compartment slide flap 90 along second compartment slide fold line 100, and is partially adjacent front panel 26 along fifth cut line 101. Second compartment slide 98 includes third catch 102. First compartment slide flap 80 is attached to minor lid 76 along first compartment slide flap fold line 82, and adjacent to second compartment slide flap 90 along fourth cut line 96. First compartment slide 84 is connected to first compartment slide flap 80 along first compartment slide fold line 86, and adjacent to second compartment slide 98 along fourth cut line 96. First compartment slide 84 includes fourth catch 104.

Rear panel 30 is connected to second compartment side panel 28 along second compartment side panel fold line 71. Rear panel 30 includes fourth bottom flap 106 connected along fourth bottom flap fold line 108 and top flap 112 connected along top flap fold line 114. Fourth bottom flap 106 is adjacent third bottom tab 72 along sixth cut line 110. As shown by the arrow in FIG. 1, a first step in assembling the box 12 from the cardboard blank 10 may be folding inner tab 18, dual compartment separator panel 20, first compartment rear panel 22, and first compartment side panel 24 preferably over one-half the width of front panel 26.

Figure 2:
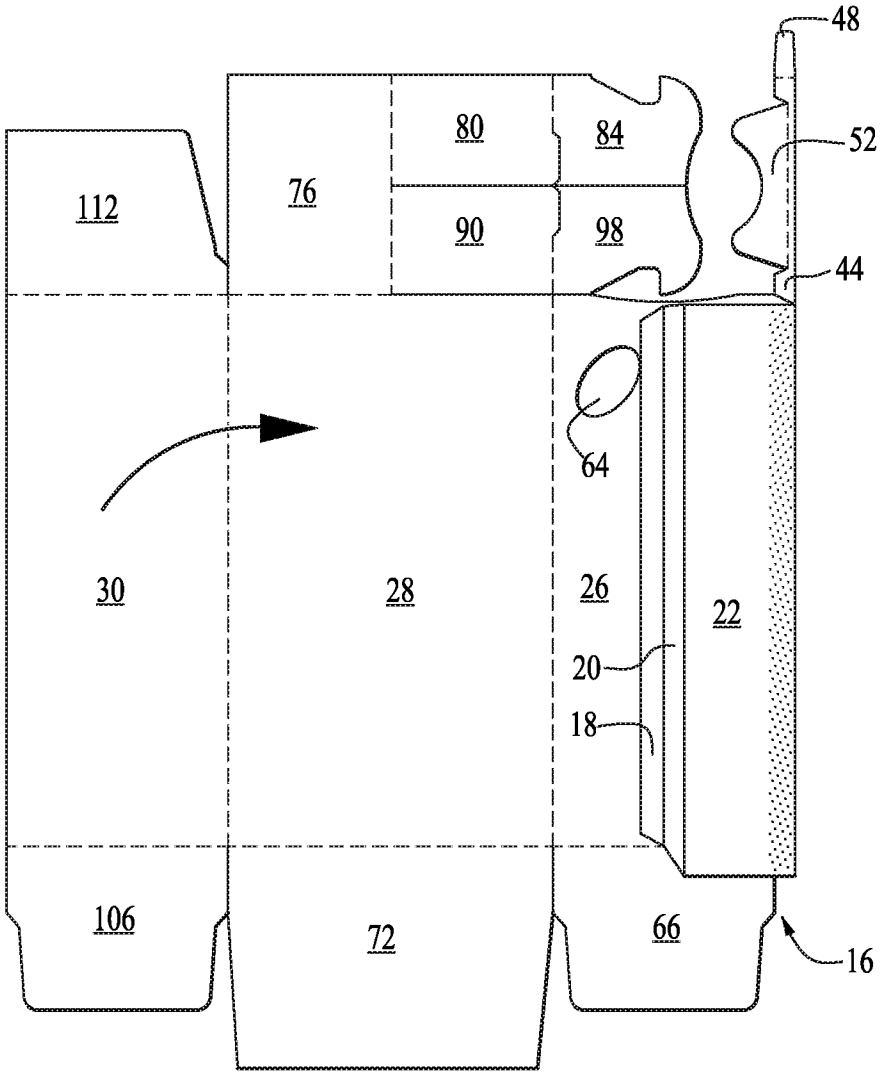
FIG. 2 is a perspective view of the cardboard blank showing a first assembly step toward forming the dual compartment box with slide openings.

Referring to FIG. 2, first compartment rear panel 22 has been folded over front panel 26 with inner tab 18 affixed thereto, thereby forming first compartment 116. Preferably, upon folding, dual compartment separator panel 20 and first compartment side panel 24 are at substantial right angles to first compartment rear panel 22. Additionally, inner tab 18 is preferably reverse folded to extend away from first compartment 116 when adhesively adhered or otherwise affixed to front panel 26. As shown by the arrow in FIG. 2, rear panel 30 is folded over front panel 26 and first compartment 116 formed by dual compartment separator panel 20, first compartment rear panel 22, and first compartment side panel 24. Preferably upon folding, front panel 26 and rear panel 30 are at substantial right angels from second compartment side panel 28. Preferably rear panel 30 is adhesively adhered or otherwise affixed to first compartment rear panel 22 of first compartment 116 thereby forming the box 12.

Figure 3:
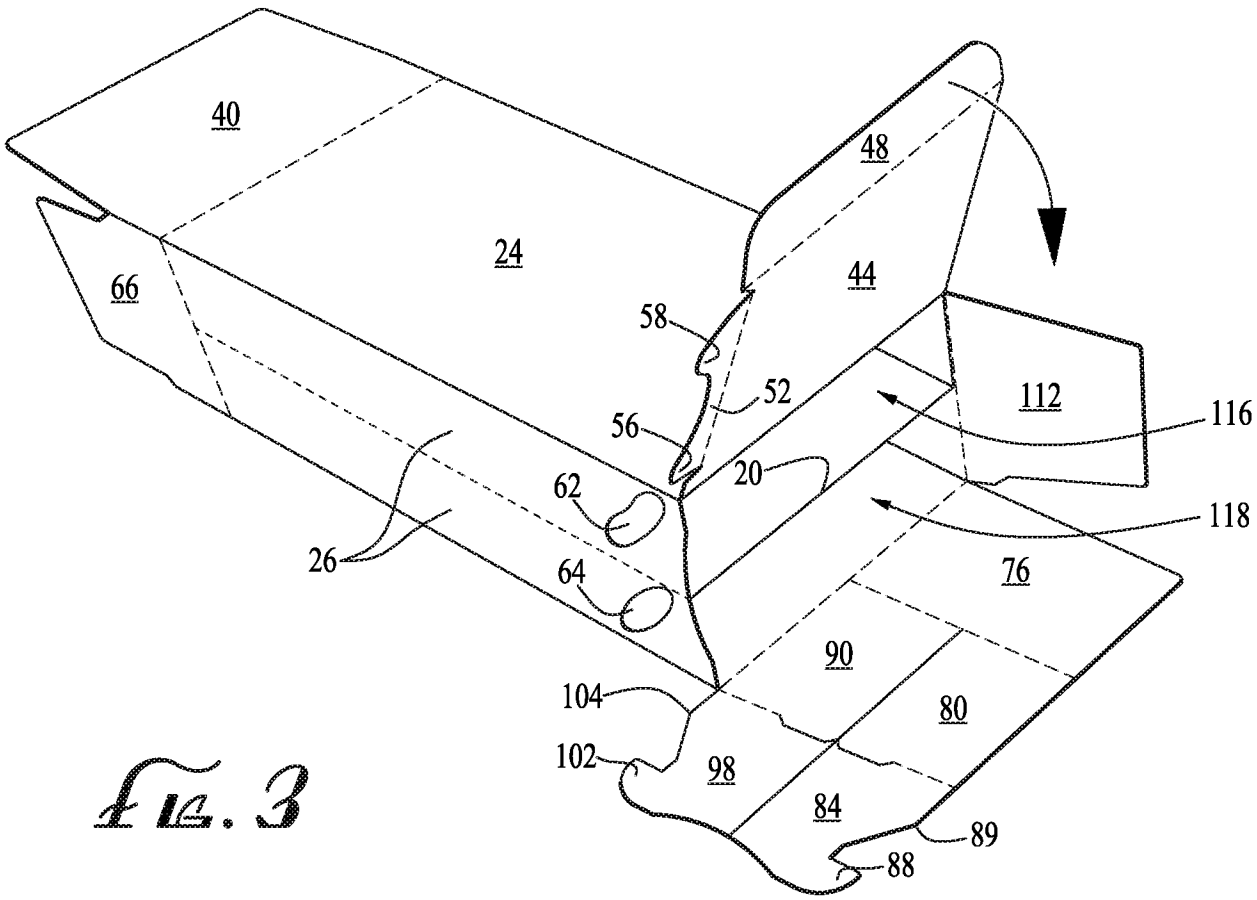
FIG. 3 is a perspective view of the cardboard blank showing a second assembly step toward forming the dual compartment box with slide openings.

Referring now to FIG. 3 with back panel 30 folded over first compartment rear panel 22 of first compartment 116, second compartment 118 is formed. A next assembly step of the box 12 may be folding top flap 112 over first compartment 116 and second compartment 118. As shown by the arrow in FIG. 3, a next assembly step of the box 12 may be folding major lid 44 over top flap 112, first compartment 116, and second compartment 118. Upon folding, major lid 44, major lid closure tab 48 is folded substantially at a right angle from major lid 44 to rest against second compartment side panel 28. Similarly, front tab 52 is folded at a substantial right angle from major lid 44, with first appendage 56 inserted into first compartment 116 and second appendage 58 inserted into second compartment 118. First appendage 56 helps to press first compartment slide 84 against first compartment aperture 62, when folded into first compartment 116, and second appendage 58 helps to press second compartment slide 98 against second compartment aperture 64 when folded into second compartment 118.

Figure 4:
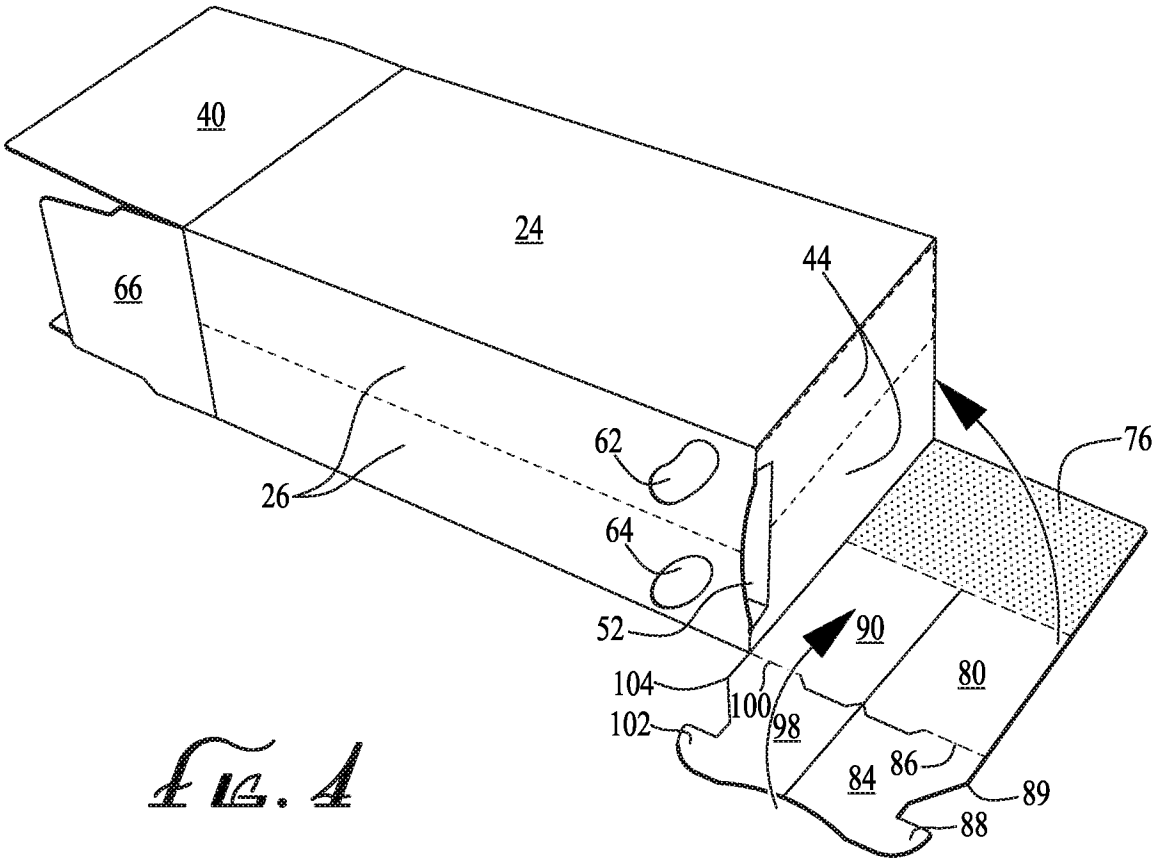
FIG. 4 is a perspective view of the cardboard blank showing a third and fourth assembly step toward forming the dual compartment box with slide openings, with the bottom flaps open.

Referring to FIG. 4, as shown by arrow adjacent first compartment slide 84 and second compartment slide 98, a next assembly step may be folding first compartment slide 84 substantially ninety degrees at first compartment slide fold line 86, and folding second compartment slide 98 substantially ninety degrees at second compartment slide fold line 100. Thereafter, minor lid 76 may be folded over major lid 44, such that first compartment slide 84 covers first compartment aperture 62 and second compartment slide 98 covers second compartment aperture 64. These actions may be performed in series or simultaneously according to preference. Upon folding, minor lid 76 is preferably adhesively adhered or otherwise affixed to major lid 44, thus preserving first compartment slide 84 in first compartment 116 and second compartment slide 98 in second compartment 118.

Figure 5:
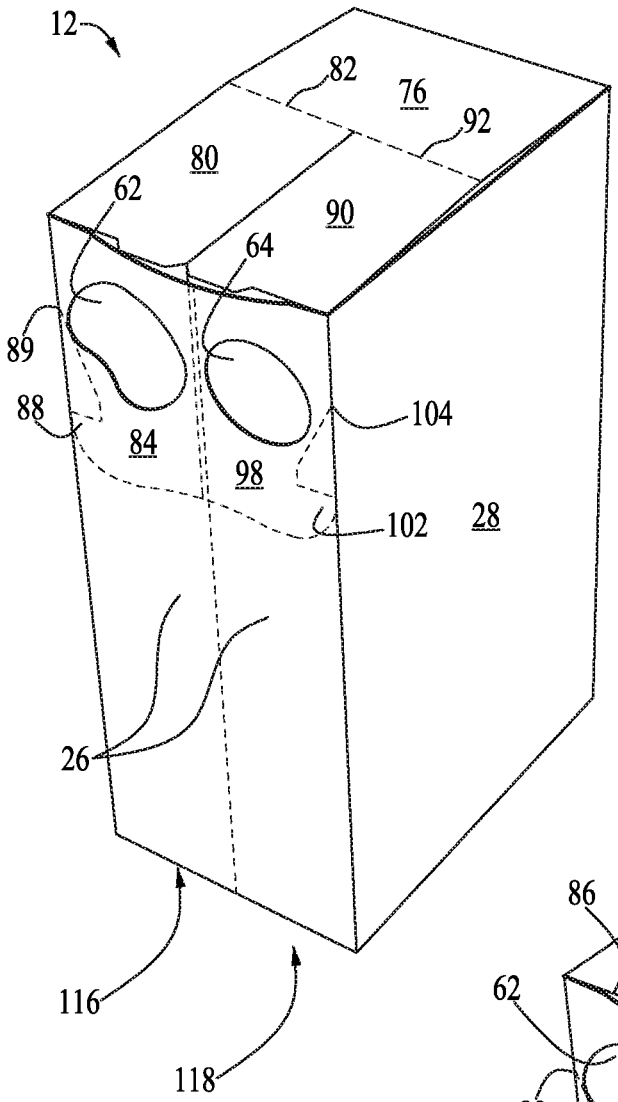
FIG. 5 is a perspective view of a fully assembled dual compartment box.

FIG. 5, shows the box 12 in a fully assembled state with the first compartment slide 84 and second compartment slide 98 in a closed configuration. The bottom end 16 of the box 12 is closed in a manner similar to a conventional box, preferably by folding over second bottom flap 66 and fourth bottom flap 106, folding over first bottom flap 40, and adhesively or otherwise adhering third bottom flap 72 to first bottom flap 40. In alternative embodiment, the various bottom flaps 40, 66, 72, 106 may be folded in a different order according to preference. Additionally, the top end 14 or bottom end 16 may be alternatively folded first or second depending on whether the pourable products are introduced to the first compartment 116 and second compartment 118 from the top or bottom of the box 12.

Figure 6:
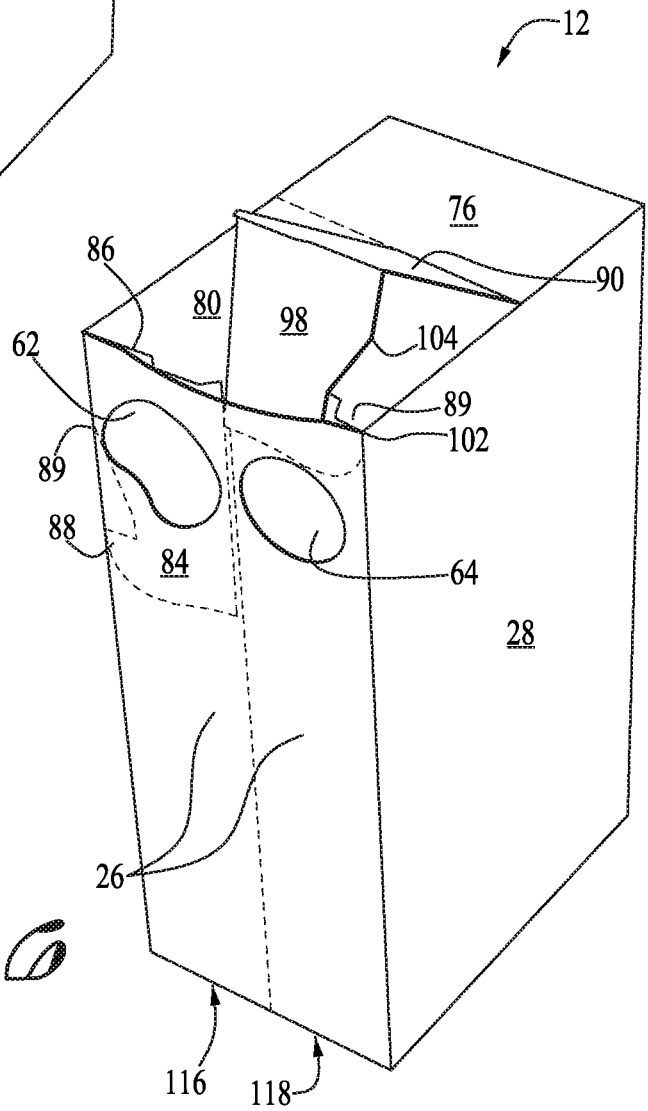
FIG. 6 is a perspective view of a fully assembled dual compartment box, showing one slide opened for accessing one of the two compartments.

Referring to FIG. 6, second compartment side flap 90 and second compartment slide 98 are in an upward position from the box 12 so that second compartment aperture 64 is exposed, creating access to second compartment 118. Interaction between second catch 89 from major lid 44 and third catch 102 from second compartment slide 98 prevents second compartment slide 98 from disengaging with major lid 44 and second compartment 118.

While particular forms of the invention have been illustrated and described, it will also be apparent to those skilled in the art that various modifications can be made without departing from the spirit and scope of the invention. Accordingly, it is not intended that the invention be limited except by the appended claims.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A package for convenient dispensing of multiple types of solid pourable product, the package comprising:

a single cardboard blank having a plurality of flap portions foldably extending from a plurality of longitudinally extending side panels, the flap portions being top and bottom flaps, and a first compartment slide and a second compartment slide separate from the first compartment slide;

the plurality of longitudinally extending side panels being formed into a box having a first compartment and a second compartment with a separator panel therebetween, the separator panel is at least partially defined by an inner tab to one edge of the panel, the inner tab being adhesively connected to the interior of the front panel, and the first compartment and the second compartment having a common front panel with a pair of apertures for the first compartment and the second compartment respectively, the pair of apertures sized to dispense the multiple types of solid pourable product therethrough, the first compartment slide and the second compartment slides being independently moveable to selectively block and unblock each of the pair of apertures;

the box further having a support tab disposed to press the first compartment slide and the second compartment slide against the front panel proximate the pair of apertures upon formation of the box, and the first and second compartment slides each having a catch to keep at least a portion of the first compartment slide and at least a portion of the second compartment slide captive inside the box upon formation of the box.

2. The package of claim 1 wherein the package further having a first compartment rear panel and a rear panel, the lateral edge of the first compartment rear panel being adhesively connected to the rear panel.

3. The package of claim 1 wherein the plurality of compartments fully extend to a bottom of the multi compartment package.

4. The package of claim 1, wherein the first compartment slide and second compartment slide are vertically movable within an interior of the multi compartment package.

5. A box for dispensing two products, the box comprising:

a single blank having a plurality of flap portions foldably connected together to a plurality of side panels, a first compartment slide, and a second compartment slide separate from the first compartment slide; and, the plurality of side panels being foldable into a box having a first compartment and a second compartment with a separator panel therebetween;

the first compartment and the second compartment having a common front panel with a pair of apertures for the first compartment and the second compartment respectively, the first compartment slide and the second compartment slides being independently moveable to selectively block and unblock each of the pair of apertures;

the box further having a support tab is disposed to press the first compartment slide and the second compartment slide against the front panel proximate the pair of apertures upon formation of the box, and the first and second compartment slides each having a catch to keep at least a portion of the first compartment slide and at least a portion of the second compartment slide captive inside the box upon formation of the box;

wherein the separator panel is at least partially defined by an inner tab to one edge of the panel, the inner tab being adhesively connected to the interior of the front panel.

6. The box of claim 5 wherein the package further having a first compartment rear panel and a rear panel, the lateral edge of the first compartment rear panel being adhesively connected to the rear panel.

7. The box of claim 5 wherein the plurality of compartments fully extend to a bottom of the multi compartment package.

8. The box of claim 5, wherein the slides are movable within the interior of the box adjacent the front panel.

* * * * *